US006887000B2

(12) United States Patent
Michaelson

(10) Patent No.: US 6,887,000 B2
(45) Date of Patent: May 3, 2005

(54) CORRECTING THE POSITION OF PRINT

(75) Inventor: Nicholas David Michaelson, London (GB)

(73) Assignee: Silver Fox Limited, Hertfordshire (GB)

( * ) Notice: Subject to any disclaimer, the term of this patent is extended or adjusted under 35 U.S.C. 154(b) by 0 days.

(21) Appl. No.: 10/381,392

(22) PCT Filed: Sep. 20, 2001

(86) PCT No.: PCT/GB01/04197

§ 371 (c)(1),
(2), (4) Date: Mar. 20, 2003

(87) PCT Pub. No.: WO02/25422

PCT Pub. Date: Mar. 28, 2002

(65) Prior Publication Data

US 2004/0083915 A1 May 6, 2004

(30) Foreign Application Priority Data

Sep. 20, 2000 (GB) ..... 0022987

(51) Int. Cl.[7] ..... B41J 3/42; B41J 5/30; B41J 21/17; B41J 11/44

(52) U.S. Cl. ..... 400/74; 400/61; 400/70; 400/76

(58) Field of Search ..... 400/615.2, 64, 400/74, 61, 70, 76; 101/128.4, 484; 345/630; 358/1.12, 1.8; 382/175

(56) References Cited

U.S. PATENT DOCUMENTS 4,403,301 A * 9/1983 Fessel ..... 358/1.8
4,627,707 A * 12/1986 Tani et al. ..... 399/184
5,186,102 A 2/1993 Kanno et al. ..... 101/128.4
5,187,774 A * 2/1993 Ericson ..... 358/1.12
5,228,100 A * 7/1993 Takeda et al. ..... 382/175
5,682,541 A * 10/1997 Martin ..... 715/507
5,806,430 A 9/1998 Rodi ..... 101/484
5,813,771 A * 9/1998 Ur et al. ..... 400/74
6,130,677 A * 10/2000 Kunz ..... 345/630

FOREIGN PATENT DOCUMENTS

| | | |
|---|---|---|
| EP | 0438899 A1 | 12/1990 |
| GB | 2312304 A | 10/1997 |
| WO | WO 81/02083 A | 7/1981 |
| WO | WO 02/25422 A2 | 3/2002 |

* cited by examiner

*Primary Examiner*—Andrew H. Hirshfeld
*Assistant Examiner*—Wasseem H. Hamdan
(74) *Attorney, Agent, or Firm*—Stetina Brunda Garred & Brucker

(57) ABSTRACT

The present invention provides a method of correcting the position of a printed image on a printable medium, the image being generated by a computer and printed on the printable medium by a printer controlled by the computer, in which the computer executes a print operation to print an image onto a printable medium; obtains co-ordinates which define the actual position of the image printed as well as the co-ordinates of a desired position of the image; and responds to the difference between the required and the actual positions to correct the image which would be generated by the computer in the next execution of the print operation such that it will be printed at the correct position. The invention also provides a computer program for implementing this method, and a system, comprising a computer and a printer, which implements the program.

12 Claims, 4 Drawing Sheets

CORRECTING THE POSITION OF PRINT

FIELD OF THE INVENTION

This invention relates to a method for correcting the position of print printed by a computer-controlled printer also relates to a computer program for implementing this method, and to a system, comprising a computer and a printer, which implements this program.

BACKGROUND ART

Automated printing processes, in which a computer-controlled printer is used to print onto a printable medium, are now commonplace. Many different types of printers are known, including ink jet, laser, dot matrix, impact matrix, thermal transfer and daisywheel types. The printable medium may be a sheet of paper or card, cloth, or one or more labels. In the case of labels, it is common for a plurality of adhesive labels to be obtained on backing paper, which is then fed through the printer. The print itself may be alphanumeric characters, text, images, bar codes or pictures.

All the above media are readily utilised over a wide range of sizes. Among large scale media, for example, are advertising posters and decalcomania. Smaller scale media are used in the printing of packaging materials and labels. Very small labels are used for labelling electronic components and wiring. In all these cases, and especially with the printing of labels, it is critically important that the print be accurately positioned on the printable medium. Incorrectly positioned print looks slipshod and unprofessional, and, if taken to an extreme case, may result in some of the desired print actually missing the intended area. This results in text and/or pictures being cropped, resulting in the need to repeat the print job, which may be both costly and time consuming.

With some jobs, such as printing instructions on pharmaceutical containers, if the print misses the desired label area the consequences can be extremely serious. In such a case, the patient might only receive part of the instructions, and this could result in him taking an inappropriate course of treatment.

In the case of very small labels, such as those used for electronic components, the labels must be aligned very accurately if the text is to be properly positioned. If the text is not positioned properly, it can be very awkward to adjust the printer or computer software to rectify the error. Traditionally this 'fine tuning' has been achieved by the user printing onto a blank sheet of paper and then holding this up against the actual sheet of labels. He then measures in some way how much various blocks of information are out (usually top left, top right and bottom left) and enters these measurements into computer software which makes the appropriate adjustments to settings such as the top margin, left margin, horizontal pitch and vertical pitch. Alternatively the user might print directly onto a sheet of labels (or a sheet on which the outlines of labels have been marked) and would then measure manually the deviation of the print from the desired position. This information would then be entered into the software which would make the necessary adjustments.

The method described above relies to a great extent on trial and error. The measurement of the deviation of the print must be made manually, and this is both slow and prone to error. Multiple test printouts often have to be made before acceptably positioned print is obtained.

It is accordingly an object of the present invention to overcome or at least mitigate one or all of the problems noted above.

SUMMARY OF THE INVENTION

According to the present invention there is provided a method of correcting the position of a printed image on a printable medium, said image being generated by a computer and printed on the printable medium by a printer controlled by the computer, in which the computer executes a print operation to print an image onto a printable medium; obtains co-ordinates which define the actual position of the image printed as well as the co-ordinates of a desired position of the image; and responds to the difference between the required and the actual positions to correct the image which would be generated by the computer in the next execution of the print operation such that it will be printed at the correct position.

Preferably the computer displays a representation of the medium and of the image, and responds to inputs from a user to determine the said coordinates of the actual position of the image.

Preferably also the computer displays a representation of the medium and of the image, and responds to inputs from a user to determine the said co-ordinates of a desired position of the image.

In a preferred embodiment, the user views the representation and the printed image and operates an electronic pointing device (such as a mouse or trackball) communicating with the computer to cause the computer to alter the position of the image relative to the medium on the representation, such as to agree with the perceived position of the printed image on the real medium. Preferably, the user inputs or selects the desired image position and causes the computer to display this on the representation of the medium.

Particularly preferably the computer displays a representation of the desired position of the image and the printable medium, and the user uses the electronic pointing device to move the representation of the position of the image relative to the representation of the medium, such as to agree with the perceived position of the printed image on the real medium. Alternatively, the computer displays a representation of the desired position of the image and the printable medium, and the user uses the electronic pointing device to move the representation of the position of the medium relative to the representation of the image, such as to agree with the perceived position of the printed image on the real medium.

This method has the advantage of being much quicker, easier and more intuitive than the trial and error methods known previously. The method can readily be incorporated into computer software, either in printer drivers themselves or in application software such as word processor programs or desktop publishing packages.

As an alternative to the user viewing the representation, which would normally be on a screen, and comparing it with the actual printed medium held nearby, it would be possible to scan in the printed medium, e.g. using a flat bed scanner connected to the computer. Thus in an alternative embodiment the computer scans the printed medium and displays it in the said representation, thereby showing the actual printed position. The user may operate an electronic pointer device communicating with the computer to identify (e.g. by point and click) the image on the representation to enable the computer to determine the co-ordinates of the actual image. The user may operate the electronic pointer device to indicate the desired position of the image on the representation to enable the computer to determine the co-ordinates of the desired position of the image.

The present invention also provides a computer program for use in a computer for correcting the position of a printed image on a printable medium, said image being generated by the computer and printed on the printable medium by a printer controlled by the computer, in which the program causes the computer to execute a print operation to print the image onto the printable medium; obtains co-ordinates which define the actual position of the image printed as well as the co-ordinates of a desired position of the image; and responds to the difference between the required and the actual positions to correct the image which would be generated by the computer in the next execution of the print operation such that it will be printed at the correct position.

Advantageously this computer program can exist as a plug-in program for incorporation into other software.

The invention also provides a computer program stored on a data carrier for use in a computer for correcting the position of a printed image on a printable medium, said image being generated by the computer and printed on the printable medium by a printer controlled by the computer, in which the program causes the computer to execute a print operation to print the image onto the printable medium; obtains co-ordinates which define the actual position of the image printed as well as the co-ordinates of a desired position of the image; and responds to the difference between the required and the actual positions to correct the image which would be generated by the computer in the next execution of the print operation such that it will be printed at the correct position.

According to the present invention there is also provided a computer system comprising a computer and a printer, said computer having been programmed with a computer program as defined above for correcting the position of print on a printable medium, said print being printed on the printable medium by the printer controlled by the computer.

BRIEF DESCRIPTION OF THE DRAWINGS

Embodiments of the present invention will now be more particularly described by way of example only, and with reference to the accompanying drawings in which.

DESCRIPTION OF THE PREFERRED EMBODIMENTS

The present embodiments represent currently the best ways known to the applicant of putting the invention into practice; but they are not the only ways in which this could be achieved. They are illustrated, and they will now be described, by way of example only.

Figure 1:
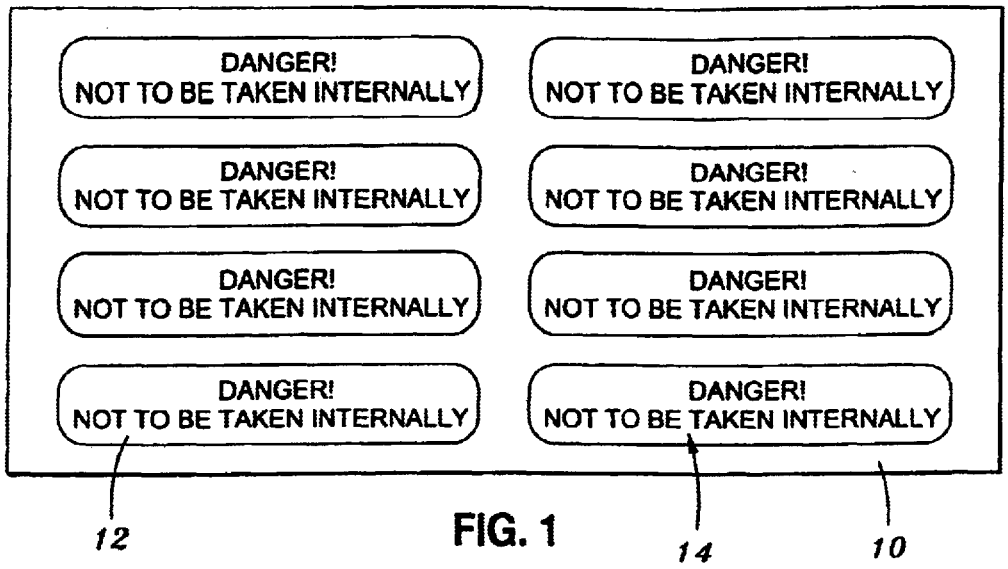
FIG. 1 is an example of a correctly printed sheet of labels.

To illustrate the application of the invention, FIG. 1 shows a sheet of waxed paper 10 having an array of eight adhesive-backed paper labels 12. In this example it is intended that text 14 should be printed on each label, although the invention is applicable to any kind of printed characters or imagery and the printed medium need not be a sheet of one or more labels. In this example, though, the text is an extremely important warning notice, and the labels are intended to be stuck onto bottles of a particular kind of pharmaceutical product.

Figure 2:
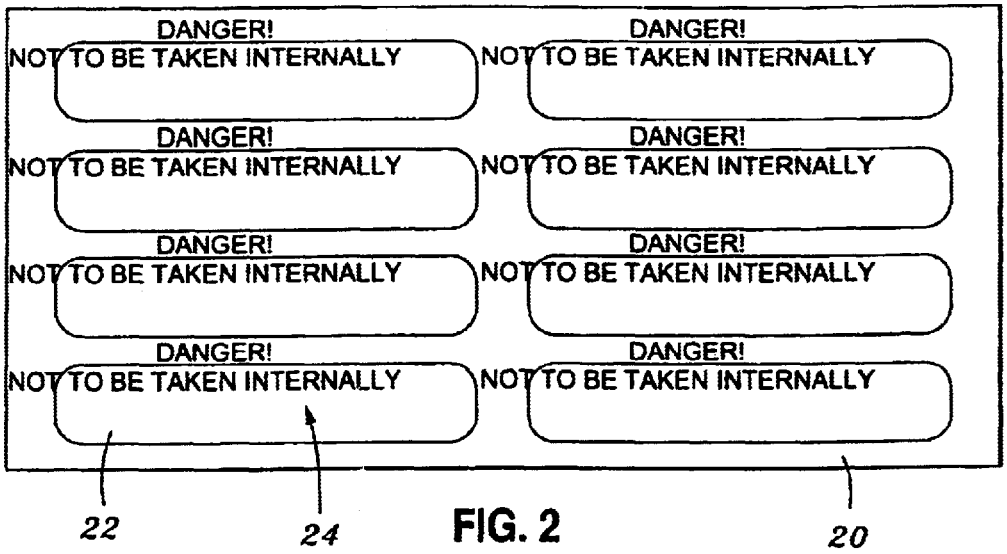
FIG. 2 (PRIOR ART)
FIG. 2 is an example of an incorrectly printed sheet of labels.
Figure 3:
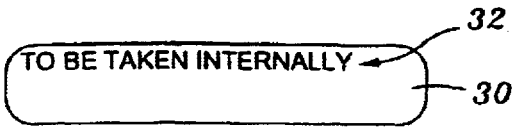
FIG. 3 (PRIOR ART)
FIG. 3 is an incorrectly printed label, removed from the sheet of FIG. 2.

FIG. 2 illustrates an inaccurately printed sheet 20 of labels 22. The text 24 has not been properly aligned with the labels. As a result, as FIG. 3 shows, when each label 30 is removed from the backing sheet the text 32 present is not as intended. In fact, in the example used in the illustrations, the meaning of the labels has now been radically altered. An unwary pharmacist may apply such a label to a bottle, and as a result the patient could risk dire consequences from erroneous consumption of this pharmaceutical product.

The computer software provided by the present invention enables the inaccurate position of the print to be corrected in a quick, simple and straightforward way.

Figure 4:
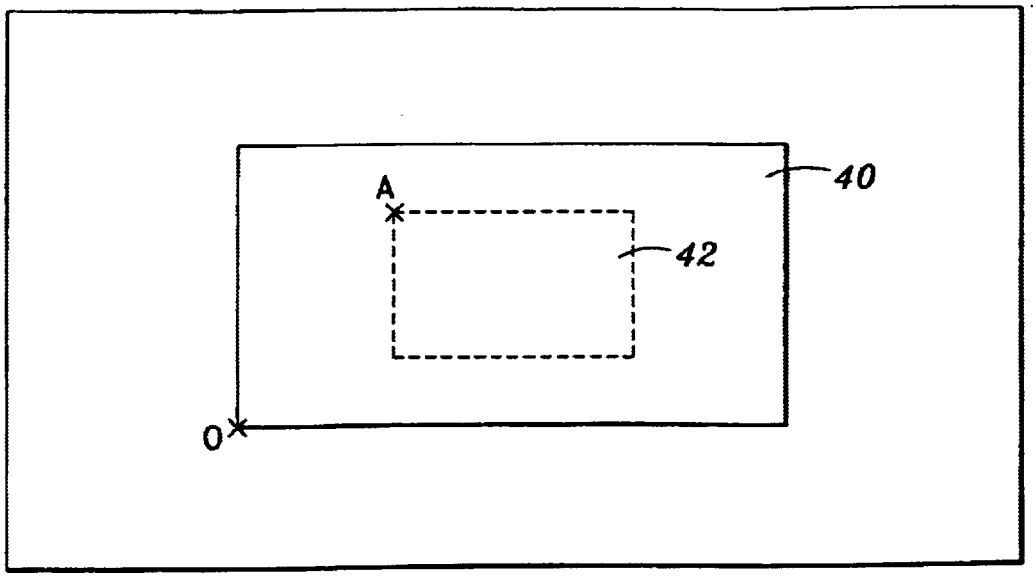
FIG. 4 is an illustration of an on-screen representation of a label indicating the desired print position.

In using this software, the user is provided (FIG. 4) with a representation of a label 40 on the computer screen. The user is required to inform the software of the desired position at which the text should appear on the label. This is done by positioning a graphical representation of the text position 42 onto the representation of the label 40. (It should be borne in mind that although the expression 'text position' is used, the text position may equally as well be the position of any kind of printable imagery.) The software records this information in the form of co-ordinates, in the frame of reference of the label or sheet of labels. In a very simple embodiment of the invention, the co-ordinates recorded correspond to the top left corner of the space to be occupied by text. In FIG. 4 these co-ordinates are simply as indicated by A, which are relative to the origin of the co-ordinate system O. This origin of the co-ordinate system is defined relative to the representation of the label, which remains static.

In a more advanced embodiment of the invention, additional co-ordinates may be required and recorded, such as the top right, bottom left and bottom right corners of the space to be occupied by text. The appropriate combination of these co-ordinates would be determined by the labelling or printing specialist to suit the particular job in hand.

A test page is printed next, either using one or more real labels on a sheet of backing paper, or using an outline of one or more labels pre-printed on a piece of paper. The test text or image which is printed may be different to the content of the actual print job for which the system is being prepared. For example, for a sheet of labels, a different alphanumeric string may be printed in the position corresponding to each of the labels.

Figure 5:
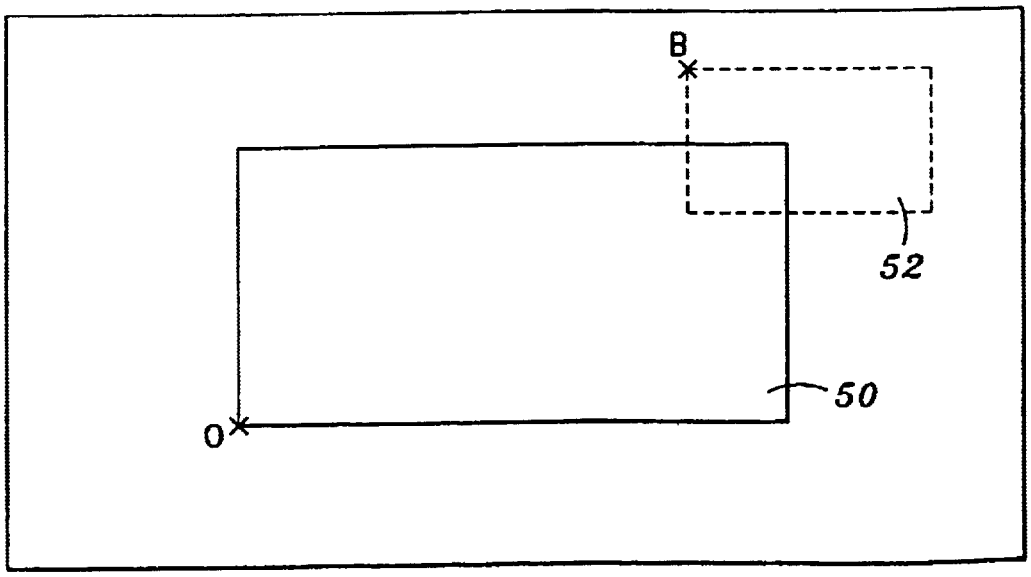
FIG. 5 is an illustration of an on-screen representation of a label which has been printed and on which the print is not in the desired position.

If the test text appears in its desired position on the printout then the user need take no further action with this software. However, if there is a discrepancy between the desired and actual text positions, then the user is required to replicate the appearance of the inaccurately-printed label on-screen. In a particularly preferred embodiment of the invention, the user, whilst viewing the actual printed test page and also viewing the computer screen, simply uses the computer mouse (or an equivalent electronic pointing device such as a trackball) to drag the representation of the text position from its position 42 in FIG. 4 to a position 52 (FIG. 5) relative to a static representation of the label 50. The position to which the representation of the text position is dragged corresponds to the actual position in which, as the user perceives it, the test text has been printed relative to the label. The same co-ordinate system is used as in FIG. 4, and the co-ordinates of the top left corner of the actual text position are indicated in FIG. 5 by B.

Alternatively, the user may drag the on-screen representation of the label 40 and reposition it relative to a static representation of the text position 42, so that the resultant relative positioning of the representations of the text 52 and the label 50 is the same as shown in FIG. 5 and again corresponds to the actual position in which, as the user perceives it, the test text has been printed relative to the label. In this case, though, the origin of the co-ordinate system as used by the program is defined in relation to the representation of the text position, since it is this (rather than the representation of the label) which remains static.

Figure 6:
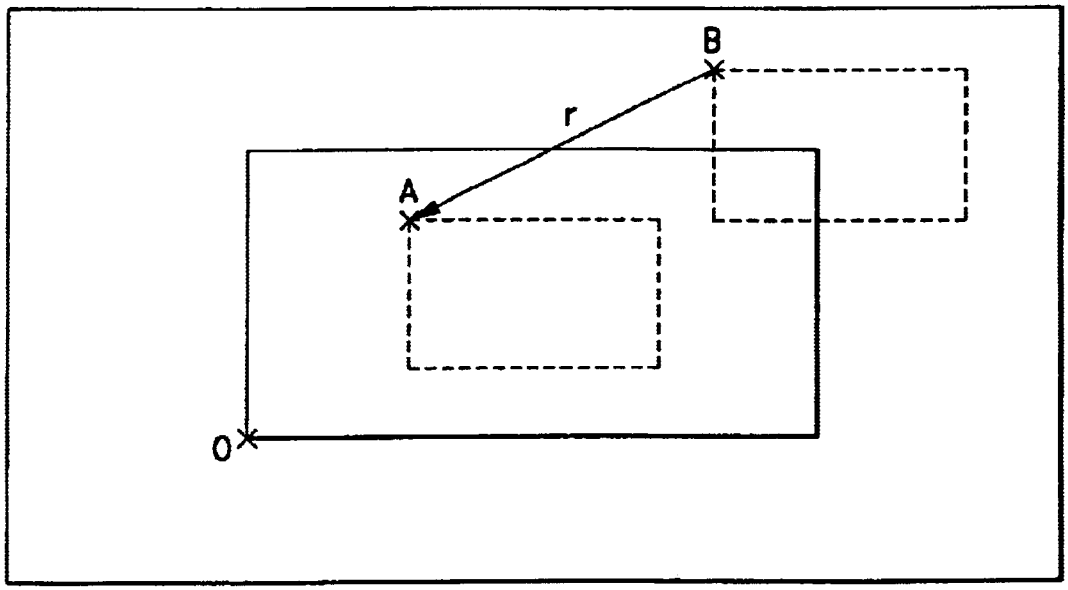
FIG. 6 shows the vector geometry used by the computer software of an embodiment of the present invention.
Figure 7:
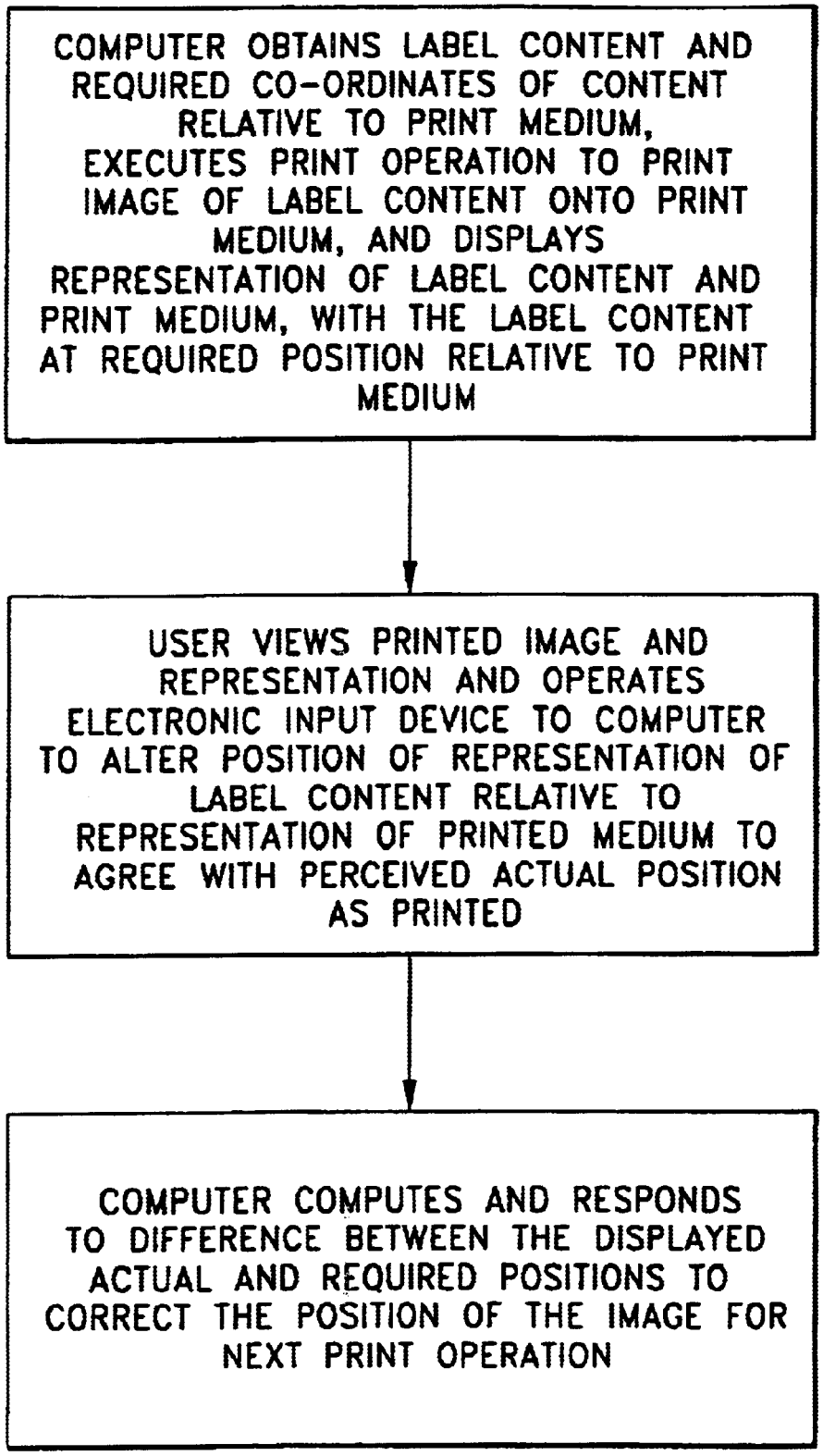
FIG. 7 is a flow chart of an exemplary sequence of steps which may be used to correct the position of print in accordance with the present invention.

Whichever of the above two methods is chosen by the user, the net result is that the user has provided the computer with information that describes the discrepancy between the actual print position and the desired print position. Given this information, the computer calculates a mapping function which, when applied to the co-ordinates defining the position of the actual printed image, results in the desired print position. In the case of the present example, applying the mapping function to the co-ordinates denoted by B results in the co-ordinates A. In this example this mapping function is a simple translation vector, but it may also be a function describing a rotation and/or an enlargement/reduction, or any combination of a translation, rotation and enlargement/reduction. In the present example, though, this vector, which is denoted by r in FIG. 6, is defined in vector notation by:

$$r=A-B$$

In all subsequent printing, the software applies the mapping function to the print co-ordinates. In this example, this involves adding the translation vector r. The print position is thereby adjusted to ensure that the subsequent printing is accurately aligned relative to the labels.

It will be appreciated that this simply corrects mis-register of the printed image with the medium by introducing a translation vector to the image. Other forms of incorrect printing, including mis-register, might include the rotation of the image, or the enlargement or reduction of the image. These errors can also be corrected using the invention, by using more than one set of co-ordinates. For example, opposite corners of the text image area could be used; the co-ordinates of the actual and of the desired positions of those corners could be obtained and processed by the computer in a similar way. The program which generates the image of the text for printing compensates for the error in response to the co-ordinates supplied to it.

The program may also be configured such that, as the user manipulates the on-screen representations of the text position and the label, appropriate numerical parameters (which may comprise the corrected numerical values for the top margin, left margin, horizontal pitch and vertical pitch) are simultaneously updated in a table on-screen, typically in a superimposed window in Microsoft Windows (RTM). However, instead of dragging the on-screen representations and observing these parameters changing, the user may alternatively enter numerical values directly into this table using the computer keyboard, or manually adjust them using input means such as the up/down cursor keys or by clicking on up/down icons with the mouse. The user is able to continue to manually adjust the values until the on-screen graphical representations conform to the test print. Alternatively, he may revert to dragging the on-screen representations using the mouse directly.

In an alternative embodiment of the invention, which relies less on the perception of the user but which involves another peripheral device, a scanner is used to scan the printed medium into the computer. In an example, a digital scanner scans an image of the incorrectly printed label. The label, i.e. the printed medium, is displayed on-screen to the user. The software itself may then be able to recognise the boundaries of the image, and hence the required co-ordinates of the actual position of the image (subject of course to any errors introduced by the scanner, which should be minimal). Alternatively, the user identifies the image position by using the mouse to point and click. The software is then used to delineate, on-screen, the position of the text relative to the label. The user may then drag the text image to the desired position relative to the surrounding medium, which is also represented on-screen. Alternatively, the user may select a desired position from options presented to him on the screen by the program. The program then processes the information about the actual and desired positions, and compensates for this in the program which generates the image to be printed, such that the mis-register error is corrected in future prints.

It will be appreciated that, for a sheet comprising an array of labels, the overall text position will span the individual labels. When printing such a sheet, the software is consequently configured such that, when printing the test page, test text is printed in the position of each label on the sheet. Rather than requiring the user to adjust, on-screen, the entire text area as a single entity to bring it into conformity with the test print, the software provides a more intuitive alternative: The user simply selects individual labels and, for each label, adjusts its on-screen representation using the techniques described previously until that label's on-screen representation conforms with the appearance of the corresponding actual label printed on the test sheet. Typically the user will apply this technique to the labels in the top left, top right and bottom left corners of the sheet, although it can equally as well be applied to the label in the bottom right corner of the sheet or any of the other labels. The computer then uses this local information as provided by the user to determine the appropriate mapping function to be applied to the entire sheet in subsequent print jobs.

The software allows the corrective mapping function to be associated with a specific label template and saved for future use. However, it also gives the option to apply the correction to just the print job(s) to be performed immediately following the test page, storing the correction in the RAM of the computer but not committing it to disk.

The software described above can be produced as a plug-in for incorporation into other software. Alternatively the software can exist as a stand-alone program, or may be incorporated into printer drivers or application software such as word processors or desktop publishing packages.

This invention is applicable to more complex printing than is described above. For example, a more sophisticated label-printing application is described in our co-pending patent application no. WO 00/48091 in which templates are produced for multiple labels on a sheet, which labels may be of different sizes and shapes. The present invention may allow for the user to shift the entire template relative to the page, by using the pointer device for example and moving an image of the template on the screen. Also, the user may wish to select just one or some of the labels, and correct them individually. The position of the printed image over the label template may require correction in one or several labels, but by different amounts. Further, the pitch between successive labels of the template can be adjusted by the user, in both horizontal and vertical directions; this can be achieved by the user pointing and clicking on the screen image of the sheet, at the appropriate corners of the intended position of the template, e.g. two or three corners. The software then adjusts the pitch to accommodate the template in the border required.

What is claimed is:

1. A method of correcting the position of an image of content of one or more labels printed on a printable medium, the image being generated by a computer and printed on the printable medium by a printer controlled by the computer, in which:

(i) the computer executes a print operation to print the image onto the printable medium;

(ii) the computer obtains co-ordinates which define a required position of the image relative to the printable medium and displays a representation of the printable medium and of the image in their required relative positions;

(iii) the computer responds to inputs from a user to determine co-ordinates of an actual position of the image printed on the printable medium in (i); and (iv) the computer computes and responds to the difference between the actual and the required positions to correct the position of the image when the image is generated by the computer in the next execution of a print operation such that the image will be printed at the correct position, wherein in (iii) the user views the representation and the image printed on the printable medium and operates an electronic input device communicating with the computer to cause the computer to alter the position of the image relative to the printable medium on the representation, such as to agree with the user's perception of the actual position of the printed image on the printable medium.

2. A method as claimed in claim 1, in which the image comprises text and the image printed in (i) is the text or a version of the text with different characters.

3. A method as claimed in claim 1, in which the user inputs or selects the required image position and causes the computer to display the required image position on the representation of the printable medium.

4. A method as claimed in claim 1, in which the computer displays a representation of the desired position of the image and the printable medium, and the user uses the electronic pointing device to move the representation of the position of the image relative to the representation of the printable medium, such as to agree with the perceived position of the printed label content image on the real printable medium.

5. A method as claimed in claim 1, in which the computer displays a representation of the desired position of the image and the printable medium, and the user uses the electronic pointing device to move the representation of the position of the printable medium relative to the representation of the image, such as to agree with the perceived position of the printed label content image on the real printable medium.

6. A method as claimed in claim 1, in which the computer, by a scanner linked therewith, scans the printed medium into the computer and displays it in the representation, thereby showing the actual printed position, and responds to inputs from a user to determine the co-ordinates of a desired position of the image, the user operating an electronic pointer device communicating with the computer to identify the image on the representation to enable the computer to determine the co-ordinates of the actual image.

7. A method as claimed in claim 6, in which the user operates the electronic pointer device to indicate the desired position of the image on the representation to enable the computer to determine the co-ordinates of the desired position of the image.

8. A computer program for use in a computer for performing the steps of the method of claim 1 for correcting the position of a printed image on a printable medium, the image being generated by a computer and printed on the printable medium by a printer controlled by the computer.

9. A computer program as claimed in claim 8, which exists as a plug-in program for incorporation into other software in the computer.

10. A data carrier storing a computer program as defined in claim 8 for use in a computer for correcting the position of a printed image on a printable medium, the image being generated by a computer and printed on the printable medium by a printer controlled by the computer.

11. A computer system comprising a computer and a printer, the computer having been programmed for performing the steps of the method of claim 1 for correcting the position of print on a printable medium, the print being printed on the printable medium by the printer controlled by the computer.

12. A method as claimed in claim 1, wherein in (i) the printable medium is a blank sheet that is then in (iii) held up against an actual sheet of labels for the user to perceive the actual position of the printed image on the printable medium and in (ii) the representation of the printable medium is a representation of the actual sheet of labels.

* * * * *